US006622346B2

(12) United States Patent
Graham et al.

(10) Patent No.: US 6,622,346 B2
(45) Date of Patent: Sep. 23, 2003

(54) SHEET MATERIAL INCLUDING A SURFACE FASTENER

(75) Inventors: Craig Graham, Eastman, GA (US); Yoshiaki Hamada, Fort Lee, NJ (US)

(73) Assignee: YKK Corporation of America, Marietta, GA (US)

( * ) Notice: Subject to any disclaimer, the term of this patent is extended or adjusted under 35 U.S.C. 154(b) by 16 days.

(21) Appl. No.: 10/021,040

(22) Filed: Dec. 19, 2001

(65) Prior Publication Data

US 2003/0110596 A1 Jun. 19, 2003

(51) Int. Cl.[7] ..... A44B 18/00

(52) U.S. Cl. ..... 24/16 R; 24/20 R; 24/30.5 R; 24/306

(58) Field of Search ..... 24/30.5 R, 30.5 P, 24/17 A, 17 AP, 16 R, 16 PB, 22, 23 R, 306, 442; 428/99, 100, 101, 343, 352, 354

(56) References Cited

U.S. PATENT DOCUMENTS 3,048,906 A * 8/1962 Patterson ..... 24/16 R
3,973,610 A * 8/1976 Ballin ..... 383/71
4,672,722 A * 6/1987 Malamed ..... 24/446
4,939,818 A 7/1990 Hahn ..... 24/16
5,048,158 A 9/1991 Koerner ..... 24/16
5,460,308 A * 10/1995 Hahn ..... 224/257
5,603,708 A * 2/1997 Seth ..... 604/389
6,044,525 A * 4/2000 Sastre et al. ..... 24/20 R
6,317,933 B1 * 11/2001 Suenaga ..... 24/16 R

* cited by examiner

*Primary Examiner*—Robert J. Sandy
(74) *Attorney, Agent, or Firm*—Kramer & Amado, P.C.

(57) ABSTRACT

A bundling strap for bundling objects is disclosed. The bundling strap has a generally trapezoidal shape and includes a first surface with loops and a second surface with hooks. The strap also have a narrow end and a wide end with an aperture. Methods of producing the strap are also disclosed. These methods includes laminating a sheet of hooks to a sheet of loops and either directly cutting the composite sheet into bundling straps and/or lining the hooks with a second sheet of loops and cutting the lined composite sheet into bundling straps.

17 Claims, 5 Drawing Sheets

1100

FIG. 12
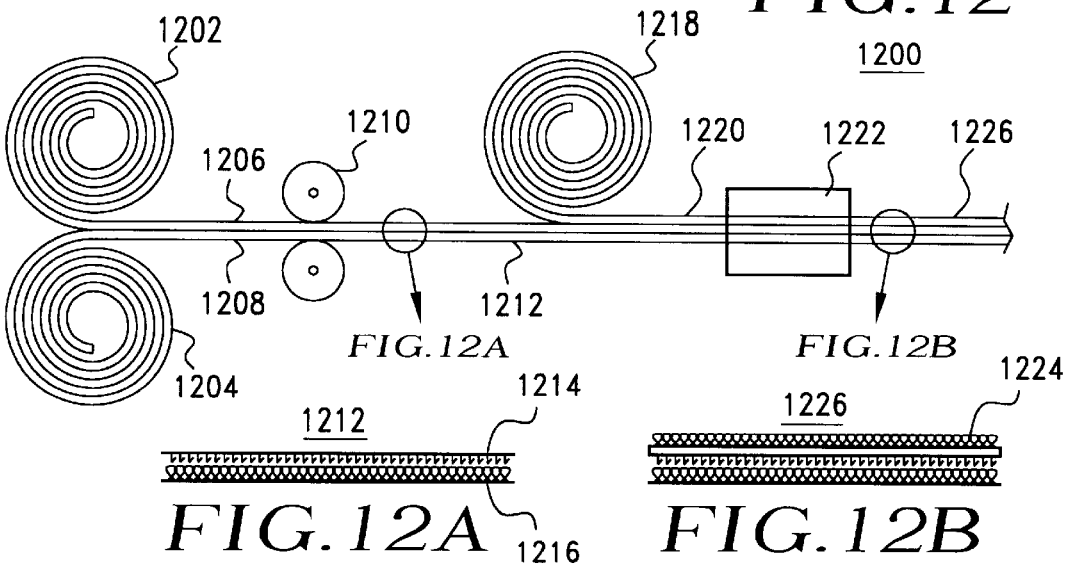
FIG. 12A FIG. 12B
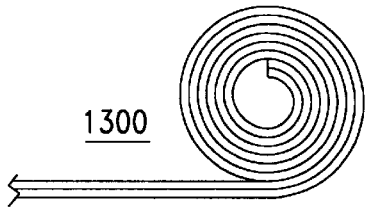
FIG. 13
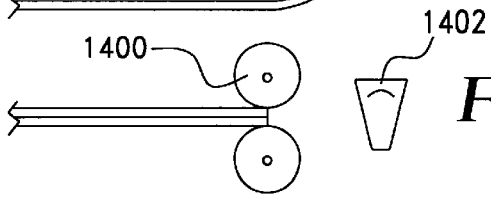
FIG. 14
FIG. 15
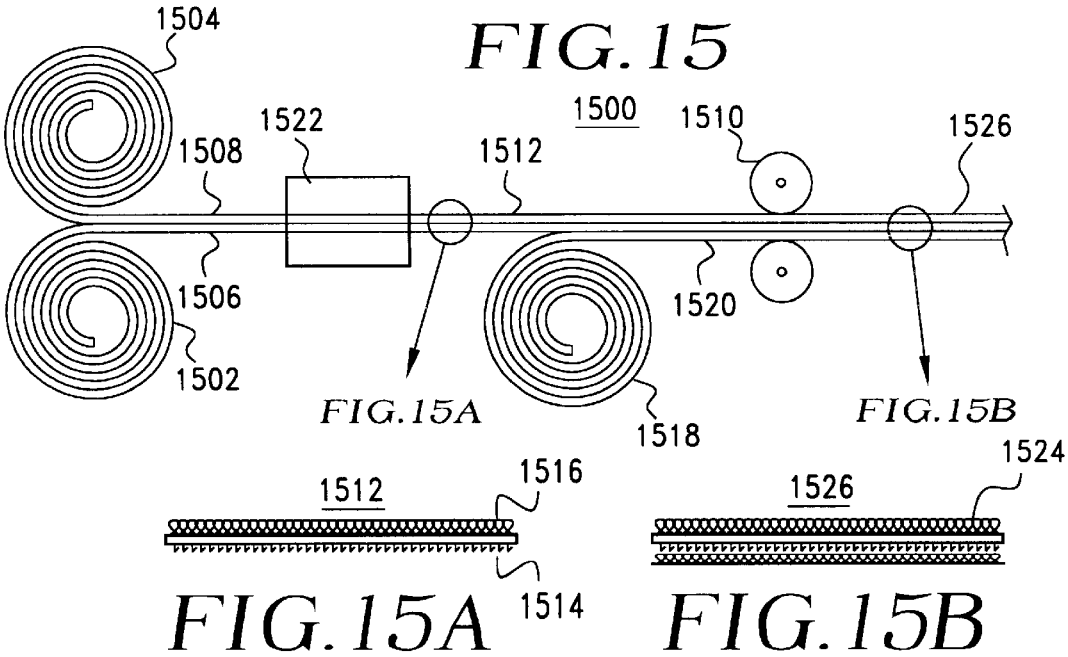
FIG. 15A FIG. 15B

SHEET MATERIAL INCLUDING A SURFACE FASTENER

BACKGROUND OF THE INVENTION

1. Field of the Invention

This invention generally relates to bundling straps. In particular, this invention relates to the manufacture and a method of using bundling straps for storage or grouping of items that may require bundling such as cable, rope, hose, produce, plants, etc.

2. Description of Related Art

Bundling straps are well known in the art and come in a variety of configurations. These straps are used to bind lengths of materials such as rope, electrical cord, cable, hoses, etc. in a coiled or bundled configuration. These straps are also used for the grouping of same or different items, such as produce, rods, etc. In the prior art, various types of items are used for bundling material. These items include tape, wire, rope, twist ties, etc. The material to be bundled is usually coiled and a twist tie, for example, is wrapped around the coil and twisted into place. This maintains the material in a coiled arrangement. Twist ties, wires and string, however, are cumbersome to use and are difficult to remove and reattach. Therefore, reusable complementary fasteners are being used as bundling straps.

U.S. Pat. No. 4,939,818 for example discloses an adjustable bundling device. It comprises a strap having hooks along both sides on an intermediate length of the strap and loops along both sides at the ends of the strap. The strap can be wrapped around an object to be coiled and the loop end portion engaged with the hooks to keep the strap in place.

Another example of bundling straps with complementary fastening surfaces is disclosed in U.S. Pat. No. 5,048,158. It shows an elongated strap having hooks on a first surface and loops on the other surface. It also includes a slot whereby one end of the strap is wrapped around a portion of the coiled object and then pushed through the slot. This maintains the strap in engagement with a portion of the coiled object. The strap is then wrapped around the remainder of the coiled object and connected to itself so that the hooks of one side engage the loops of the other sides of the strap.

Although the use of bundling straps are well known in the art, there continues to be a need for providing a cost sensitive strap and an efficient method of making such a strap.

Thus, it is an object of the present invention to provide for an inexpensive yet reusable bundling strap.

It is another object of the present invention to provide an efficient method for producing an inexpensive bundling strap.

It is a further object of the present invention to provide for a method of producing bundling straps with complementary fastening members that do not stick to each other during fabrication and distribution.

The foregoing objects and advantages of the invention are illustrative of those that can be achieved by the present invention and are not intended to be exhaustive or limiting of the possible advantages which can be realized. Thus, these and other objects and advantages of the invention will be apparent from the description herein or can be learned from practicing the invention, both as embodied herein, or as modified in view of any variation which may be apparent to those skilled in the art. Accordingly, the present invention resides in the novel methods, arrangements, combinations and improvements herein shown and described.

SUMMARY OF THE INVENTION

In light of the present need for providing inexpensive bundling straps and an efficient method for producing these bundling straps, a brief summary of the present invention is presented. Some simplifications and omission may be made in the following summary, which is intended to highlight and introduce some aspects of the present invention, but not to limit its scope. Detailed descriptions of a preferred exemplary embodiment adequate to allow those of ordinary skill in the art to make and use the invention concepts will follow in later sections.

A bundling strap is disclosed that includes a first side having a first fastening surface and, optionally a second side with a second fastening surface. The first fastening surface and the second fastening surface are complementary to each other as for example hooks and loops. The strap includes a wide end having an aperture or slit and a narrow end, which can be inserted into the aperture of the wide end. The strap also narrows progressively from the wide end to the narrow end. In use, the strap is wrapped around an object to be bundled. The narrow end is inserted into the aperture of the wide end and pulled through. The first fastening surface is then placed into engagement with the second fastening surface to hold the strap in place.

Further, a fastening material is disclosed comprising a sheet material with first and second complementary fastening surfaces. The fastening material includes a liner that is complementarily joined to one, or both of the surfaces.

In addition to the apparatus, methods for manufacturing bundling straps are also disclosed. In one method of the present invention, a first sheet material having a first fastening surface, such as a male engaging surface, is provided and brought into contact with a liner material having a complementary fastening surface, such as a female engaging surface. This produces a sheet having a male engaging surface covered with a liner material. A second sheet having a second fastening surface, such as a female engaging surface, is then provided and laminated along the opposite side of the male engaging members of the first sheet material. This produces a composite sheet of material having hooks on a first surface and loops on a second surface. It also includes a liner sheet of loops covering and engaged with the hooks of the first surface. This keeps the composite sheet from sticking to itself during processing. The composite sheet is then fed into a die cutting machine, which severs the sheet laterally into individual flexible straps having a wide end with an aperture and a narrow end and wherein the strap narrows progressively from the wide end to the narrow end. The resulting bundling straps have a liner sheet, engaged with the hooks of the first surface, which prevent the straps from engaging with each other during packaging and distribution.

BRIEF DESCRIPTION OF THE DRAWINGS

In order to better understand the present invention, reference is made to the accompanying drawings, wherein:

FIG. 12 shows a machine for producing the bundling strap via a forth method.

FIG. 12*a* shows a detail of the male sheet with liner.

FIG. 12*b* shows a detail of the composite sheet with liner.

FIG. 13 shows an intermediate step of winding the composite sheet with liner.

FIG. 14 shows a final step of severing the composite sheet with liner into bundling straps.

FIG. 15 shows a machine for producing the bundling strap via a fifth method.

FIG. 15*a* shows a detail of the composite sheet material.

FIG. 15*b* shows a detail of the composite sheet material with the liner.

DETAILED DESCRIPTION OF THE PREFERRED EMBODIMENTS OF THE INVENTION

Figure 1:
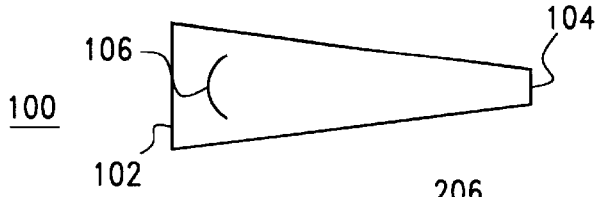
FIG. 1 shows a top view of one embodiment of the bundling strap.

Referring now to the drawings, in which like numerals refer to like components or steps, there are disclosed broad aspects of the preferred embodiments of the present invention. The embodiments shown include complementary fasteners, which may be manufactured according to manufacturing processes commonly known in the art. These manufacturing processes include extrusion, molding, injection-molding, weaving, knitting techniques, as well any other manufacturing processes commonly known for the manufacture of such fasteners. By complementary fasteners, the present invention encompasses the numerous products, which allow for one portion of material having a profiled structure to engage a second portion of material having a profiled structure. These include hook and loop, surface fasteners, mating fasteners and other complementary devices having a profiled structure.

FIG. 1 shows a first embodiment of the bundling strap 100. The strap 100 includes a narrow end 104 and a wide end 102 having an arch shaped slit 106. The slit 106 allows for a substantial portion of the strap 100 beyond the narrow end 104 to be pulled through. Slit 106 also reduces waste and increases production efficiency because no excess material is created during strap 100 production. The strap 100 is generally trapezoidal in shape. This shape allows for multiple straps to be cut from a single sheet of material without wasting surface area of the sheet. Compared to a strap having a rectangular shape, a strap having a generally triangular shape allows for more bundling straps 100 to be cut per surface area of a sheet.

Figure 2:
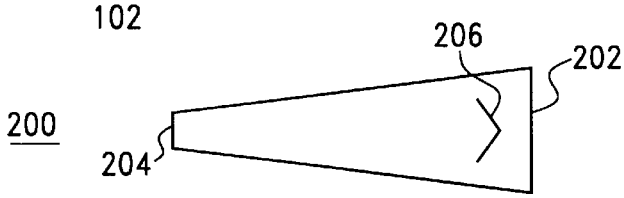
FIG. 2 shows a top view of a second embodiment of the bundling strap.

FIG. 2 shows a second embodiment of the bundling strap 200. The strap 200 includes a narrow end 204 and a wide end 202 having a V-shaped slit 206. The V-shaped slit 206 allows for a substantial portion of the strap 200 beyond the narrow end 204 to be pulled through. The slit 206 also reduces waste and production efficiency because no excess material is created during strap 200 production. The strap 200 is generally trapezoidal in shape.

Figure 3:
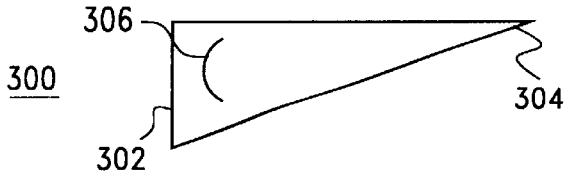
FIG. 3 shows a top view of a third embodiment of the bundling strap.
Figure 4:
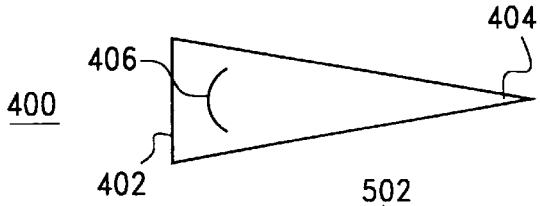
FIG. 4 shows a top view of a forth embodiment of the bundling strap.

FIG. 3 shows a third embodiment of the bundling strap 300. The strap 300 is generally shaped as a right triangle and includes a narrow end 304 and a wide end 302 including an arch shaped slit 306. FIG. 4 shows a forth embodiment of the bundling strap 400. The strap 400 is generally shaped as an isosceles triangle and includes a narrow end 404 and a wide end 402 having an arch shaped slit 406. In all four embodiments described above, an arch shaped slit 106 or a V-shaped slit 206 are shown as a preferred aperture for pulling the narrow end 104 through the wide end 102. However, any slit shape or aperture may be used. For example, a circular aperture or other geometric shape will function to perform the intended purpose, but a slit is preferred due to the greater fastening ability created by the friction of a smaller aperture.

Figure 5:
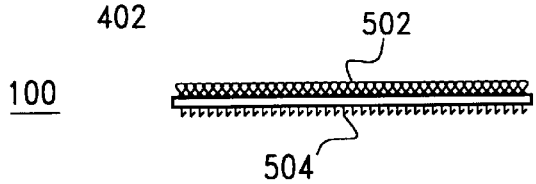
FIG. 5 shows a side view of the bundling strap.

FIG. 5 shows a side view of any of the above embodiments of the bundling strap (100) shown in FIGS. 1–4. Loops 502 are shown on a first surface of the strap 100 while hooks 504 are shown on the opposite surface of the strap 100. In the preferred embodiment, the loops 502 are constructed of knitted fibers and the hooks 504 are created via an extrusion molding process. This provides the bundling strap 100 with a very thin profile. The first and second surfaces may also include combinations of both hook and loop fasteners. Alternatively, only one surface may include hook fasteners, loop fasteners, and combinations thereof. Further, these may be placed on only a portion of the strap, such as the narrow end. The surface may also comprise combinations of both hook and loop, either in a pattern or randomly oriented.

Figure 6:
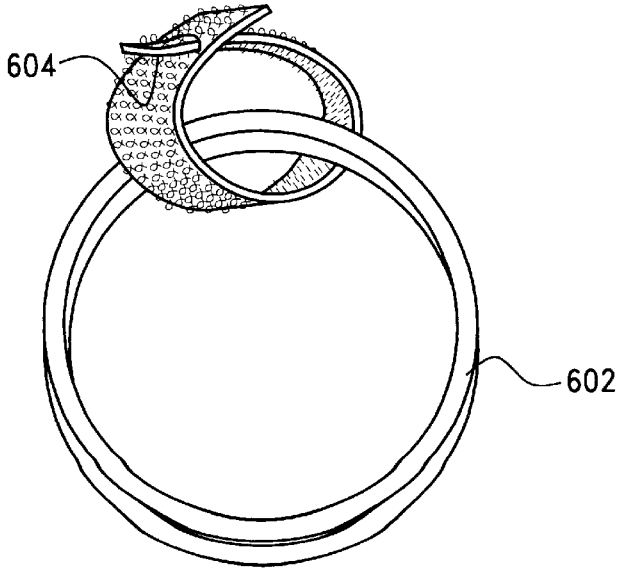
FIG. 6 shows the bundling strap in uses on a coiled object.

FIG. 6 shows one embodiment of the bundling strap 100 in use. Bundling strap 100 is wrapped around an object 602 to be coiled or bundled. The narrow end 104 is inserted into the arch shaped slit 106 of the wide end 102 and pulled through to tighten the strap 100 around the object 602. The hooks 504 of the narrow end 104 are then forced into the loops 502 on a portion of the strap 100 near the wide end 102 thus engaging the strap 100 in a locked arrangement.

Figure 7:
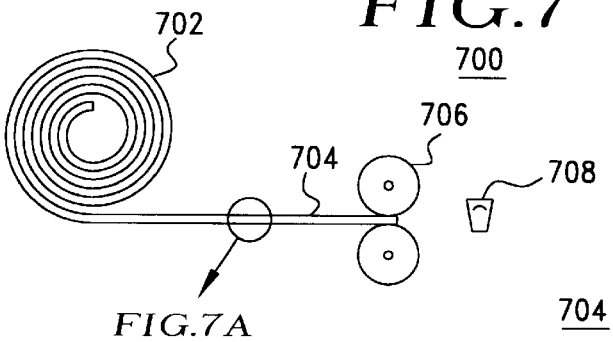
FIG. 7 shows a machine for producing the bundling strap via a first method.
Figure 7A:
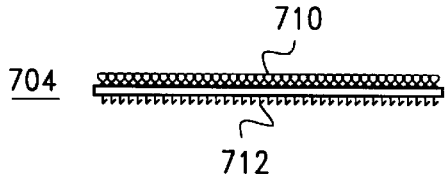
FIG. 7*a* shows a detail of the composite sheet material used in producing the bundling strap via a first method.
Figure 8:
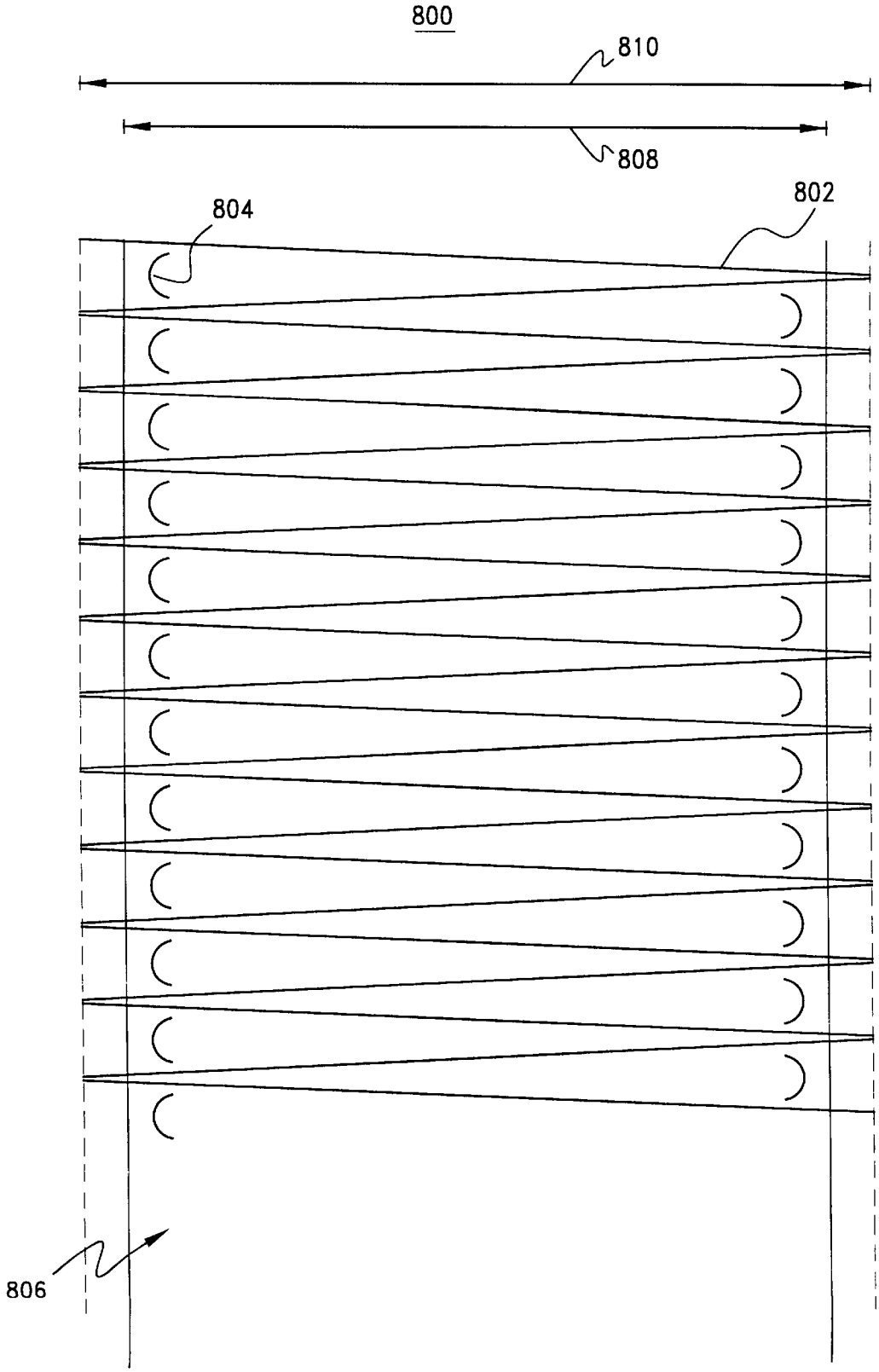
FIG. 8 shows a detail of the die cutter used to sever the sheet of material used for making the bundling strap.

The various methods of making the bundling strap 100 will now be described. Referring now to FIG. 7, an apparatus 700 for making the bundling strap 100 via a first method is shown. A spool 702 of composite sheet material 704 is provided. The composite sheet material 704 is fed into a cutter 706, which cuts the composite sheet material 704 into bundling straps 100. A detail of the composite sheet material 704 is shown in FIG. 7*a*. The composite sheet material 704 consists of hooks 712 on a first side and loops 710 on the opposite side. A detail of the cutter 706 is shown in FIG. 8.

The cutter 706 is conventional in the art and consists of an anvil type cylinder and a cutting cylinder. The cutting arrangement 800 consists of long blades 802 angled across the cylinder and arch shaped blades 804 located at one end between each set of long blades 802. The sheet material 806 is shown in perspective with the cutting arrangement 800. As shown, the width 808 of the sheet material 806 is less than the width 810 of the long blades 802. This provides for the trapezoidal shape of the bundling strap 100. Upon actuation of the cutter 706, a plurality of cuts are made to the sheet material. Said cuts may extend substantially through said sheet material and will result in straps having one wide end that progressively narrows towards a narrow end. The cutting arrangement leads to straps that are alternately juxtaposed, so no material is wasted in producing the bundling strap 100 and no excess material removal is needed.

Figure 9:
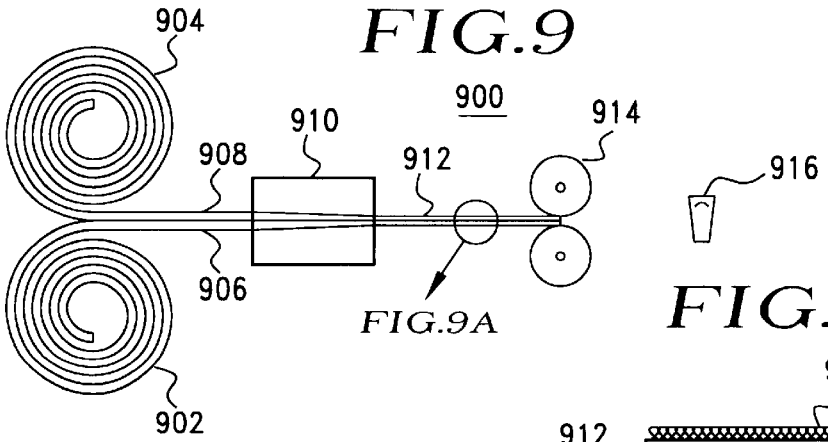
FIG. 9 shows a machine for producing the bundling strap via a second method.
Figure 9A:
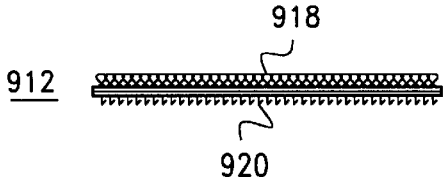
FIG. 9*a* shows a detail of the composite sheet material used in producing the bundling strap via a second method.

FIG. 9 shows an apparatus 900 for producing the bundling strap 100 via a second method. A spool of hook material 902 is provided along with a spool of loop material 904. The spool of hook material 902 is a rolled sheet of hooks 906 while the spool of loop material 904 is a rolled sheet of loops 908. The sheet of loops 908 and sheet of hooks 906 are then fed together through a laminator 910. The laminator 910 is conventional in the art and can consist of any machine, which glues, welds, or otherwise binds these sheets of material together. The sheet of loops 908 and sheet of hooks 906 are laminated by the laminator 910 to produce a composite sheet 912 that exits the laminator 910. A detail of the composite sheet 912 is shown in FIG. 9*a*. Loops 918 are on a first side of the composite sheet 912 while hooks 920 are on the opposite side. The composite sheet 912 is then fed into the cutter 914 and as described above is cut into bundling straps 916.

Figure 10:
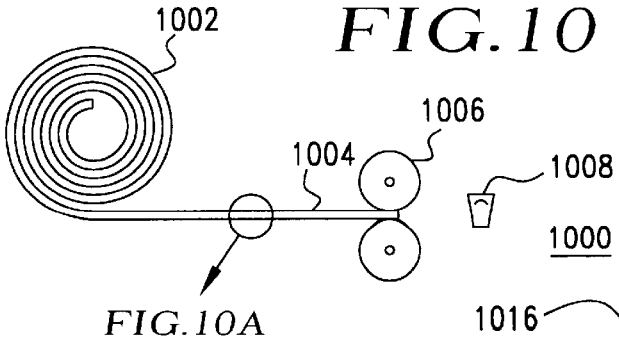
FIG. 10 shows a machine for producing the bundling strap via a third method.
Figure 10A:
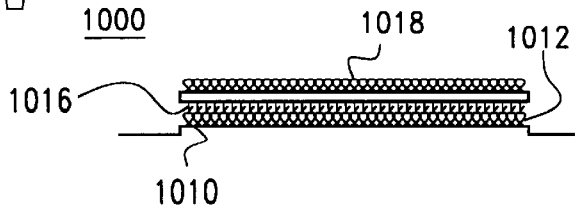
FIG. 10*a* shows a detail of the composite sheet material with liner used in producing the bundling strap via a third method.

FIG. 10 shows an apparatus 1000 for producing the bundling strap 100 via a third method. A spool 1002 of composite sheet material with liner 1004 is provided. A detail of the composite sheet material with liner 1004 is shown in FIG. 10*a*. The composite sheet 1018 is provided and includes a liner 1010. The liner material cover comes into contact with at least one fastening surface. For example the liner 1010 may be configured to include loops 1012, which engage the hooks 1016 of the composite sheet 1014. Alternatively, the liner material may be a woven, non-woven, polymeric or a composite sheet. The material may come into contact with the composite sheet material and bind to the sheet material in a variety of ways. For example, if a film material is used, it may attach via static. Woven and non-woven materials may also attach, due to their affinity for the sheet material.

Figure 11:
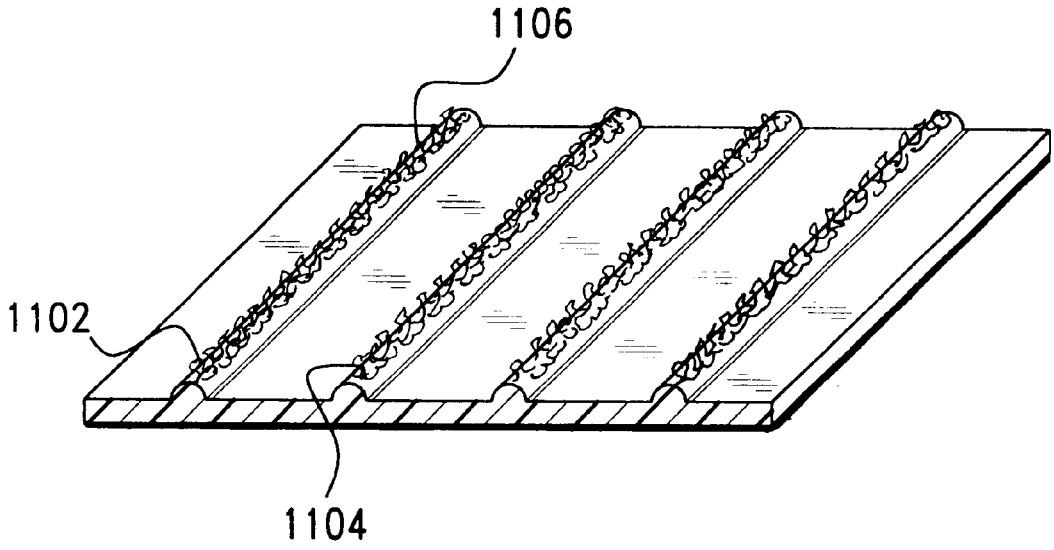
FIG. 11 shows a detailed view of the liner used in producing the bundling strap.

This arrangement allows for easy unrolling and handling of the composite sheet 1014. The liner 1010 stays with the composite sheet 1014 throughout the cutting process and remains engaged with the hooks 1016 even after the composite sheet 1014 has been cut. In the preferred embodiment, the liner is cut in the same severing function, and will form the same shape as the bundling strap. Therefore, the bundling straps 1008 include a portion of the liner 1004. In a variation of this embodiment, the severing function may cut only the sheet material, producing severed straps, while the liner will remain as an unsevered sheet. This provides for easier packaging and distribution of the bundling straps 1008. FIG. 11 shows a detail of a preferred liner 1100 having a female engaging surface. The liner 1100 is a sheet of loop material created winding thread 1106 around a central thread 1104 in a lose arrangement. This material is then engaged with polymeric material as it is hardened. This produces a sheet of loop material at a much reduced costs. Although this type of loop material is preferred, it should be noted that any type of loop material or other type of liner material may also be used.

FIG. 12 shows an apparatus 1200 for producing bundling straps 100 by yet another method. A spool of hooks 1202 and a spool of liner 1204 are provided. A sheet of hooks 1206 and sheet of liner 1208 are pulled from the spools 1202 and 1204 and brought through an engagement point which forces the sheet of liner 1208 into engagement with the sheet of hooks 1206. A detail of the contact is shown in FIG. 12*a* wherein the resulting sheet 1212 is shown with hooks 1214 engaging the loops 1216 of the liner 1208. The liner 1208 is the same liner as described above. A spool 1218 of loops is provided and a sheet of loops 1220 is pulled from the spool 1218 and brought through a laminator 1222 with the resulting sheet 1212 from the previous engagement point 1210. The sheet of loops 1220 is laminated to the resulting sheet 1212 thus forming a lined composite sheet 1226. A detail of this sheet 1226 is shown in FIG. 12*b* wherein the loops 1224 of the sheet of loops 1220 is shown. From this point, the composite sheet with liner 1226 can either be rolled onto a spool 1300 as shown in FIG. 13 for later processing or sent directly to a cutter 1400 as shown in FIG. 14 for cutting into bundling straps 1402. If the composite material will be severed, it may be fed into a die cutting machine and severed either in a direction substantially lateral to the feeding direction, or in a direction substantially parallel to the feeding direction. The composite sheet may also be severed using other severing method and devices currently known in the art, such as saws, blades and heated cutters.

FIG. 15 shows another apparatus 1500 for carrying out yet another method of producing the bundling strap 100. A spool 1502 of hooks and a spool 1504 of loops are provided. A sheet of hooks 1506 and a sheet of loops 1508 are pulled form the spools 1502 and 1504 and brought to a laminator 1522 wherein the sheets 1506 and 1508 are laminated as previously described above. The composite sheet 1512 includes loops 1516 on a first side and hooks 1514 on the opposite side as shown in FIG. 15*a*. A spool 1518 of liner is provided and a sheet of liner 1520 is pulled from the spool 1518 and brought into engagement with the hooks 1514 of the composite sheet 1512 at an engagement point 1510. This produces a lined composite sheet 1526 shown detailed in FIG. 15*b*. The lined composite sheet 1526 can either be rolled onto a spool 1300 as shown in FIG. 13 for later processing or sent directly to a cutter 1400 as shown in FIG. 14 for cutting into bundling straps 1402. Again, the composite sheet may be severed according to a variety of methods previously discussed.

Although the present invention has been described in detail with particular reference to preferred embodiments thereof, it should be understood that the invention is capable of other different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the claims.

What is claimed is:

1. A flexible strap, comprising:

a first side having a first fastening surface;

a second side having a second fastening surface which is complementary to the first fastening surface;

a narrow end;

a wide end that is wider than the narrow end; and wherein the entire strap narrows progressively from the wide end to the narrow end.

2. The flexible strap of claim 1, wherein the shape of the strap is a trapezoid or a triangle.

3. The flexible strap of claim 1, further comprising an aperture on the wide end.

4. The flexible strap of claim 3, wherein the aperture is a slit, an arch or a V-shape.

5. The flexible strap of claim 2, further comprising an aperture on the wide end.

6. The flexible strap of claim 5, wherein the aperture is a slit, an arch or a V-shape.

7. The flexible strap of claim 1, wherein the first fastening surface consists of loops and the second fastening surface consists of hooks.

8. The flexible strap of claim 1, wherein the first fastening and second fastening surfaces consist of combinations of both hooks and loops.

9. A flexible strap for bundling objects, comprising:

a first side having a first fastening surface;

a second side having a second fastening surface which is complementary to the first fastening surface;

a narrow end;

a wide end having an arch shaped slit for receiving the narrow end; and wherein the strap narrows from the wide end to the narrow end forming a trapezoidal shape.

10. The flexible strap of claim 9, wherein the first fastening surface consists of loops and the second fastening surface consists of hooks.

11. A flexible strap, comprising:

a first side having a first fastening surface consisting of a combination of both hooks and loops;

a narrow end;

a wide end that is wider than the narrow end;

wherein the entire strap narrows progressively from the wide end to the narrow end.

12. The flexible strap of claim 11, wherein the hooks are on the narrow end.

13. The flexible strap of claim 12, further comprising an aperture on the wide end.

14. The flexible strap of claim 11 wherein the loops are on the narrow end.

15. The flexible strap of claim 14, further comprising an aperture on the wide end.

16. The flexible strap of claim 11, wherein the hooks and loops are randomly oriented.

17. The flexible strap of claim 16, further comprising an aperture on the wide end.

* * * * *

UNITED STATES PATENT AND TRADEMARK OFFICE

CERTIFICATE OF CORRECTION

PATENT NO. : 6,622,346 B2
DATED : September 23, 2003
INVENTOR(S) : Craig Graham et al.

It is certified that error appears in the above-identified patent and that said Letters Patent is hereby corrected as shown below:

Column 3,
Line 1, delete the word “uses” and replace with -- use --

Column 4,
Line 26, delete the word “(100)” and replace with -- 100 --
Line 41, delete the word “100” and replace with -- 604 --

Column 5,
Line 34, delete the word “1014” and replace with -- 1018 --
Line 43, delete the word “1014” and replace with -- 1018 --
Line 46, delete the word “1014” and replace with -- 1018 --
Line 59, delete the word “costs” and replace with -- cost --

Signed and Sealed this

Tenth Day of February, 2004

JON W. DUDAS
*Acting Director of the United States Patent and Trademark Office*